US009751329B2

(12) United States Patent
Chang

(10) Patent No.: US 9,751,329 B2
(45) Date of Patent: Sep. 5, 2017

(54) METHOD FOR PRINTING ON ELEVATION CONTOURS OF THE PRINT OBJECT

(71) Applicant: Yuan Chang, Newtown Square, PA (US)

(72) Inventor: Yuan Chang, Newtown Square, PA (US)

( * ) Notice: Subject to any disclaimer, the term of this patent is extended or adjusted under 35 U.S.C. 154(b) by 0 days.

(21) Appl. No.: 14/908,537

(22) PCT Filed: Aug. 22, 2013

(86) PCT No.: PCT/CN2013/082067
§ 371 (c)(1),
(2) Date: Jan. 29, 2016

(87) PCT Pub. No.: WO2015/024234
PCT Pub. Date: Feb. 26, 2015

(65) Prior Publication Data
US 2016/0167396 A1 Jun. 16, 2016

(51) Int. Cl.
*B41J 3/407* (2006.01)

(52) U.S. Cl.
CPC ..... *B41J 3/4073* (2013.01)

(58) Field of Classification Search
CPC ..... B41J 3/4073
See application file for complete search history.

(56) References Cited

U.S. PATENT DOCUMENTS

| | | | | |
|---|---|---|---|---|
| 6,335,978 | B1 | 1/2002 | Moscato | |
| 6,644,763 | B1 | 11/2003 | Gothait | |
| 7,369,265 | B1 | 5/2008 | Lapstun et al. | |
| 8,152,167 | B2 | 4/2012 | Saito et al. | |
| 8,317,285 | B2 | 11/2012 | Nubson et al. | |
| 8,705,112 | B2 | 4/2014 | Eom et al. | |
| 2002/0024544 | A1 | 2/2002 | Codos et al. | |
| 2007/0070099 | A1* | 3/2007 | Beer | B41J 2/0456 347/8 |
| 2012/0243928 | A1* | 9/2012 | Schweid | B41J 11/0095 400/583 |

* cited by examiner

*Primary Examiner* — Jason Uhlenhake

(57) ABSTRACT

The present invention provides a method using a non contact Z height laser scan sensor to measure/detect an object surface containing extruded shapes with different Z axis elevation heights to determine the position where to precisely inkjet print outline contours, legends, logo images, or solid fill with materials. The apparatus consist of a printing carriage, a supporting beam, a printing platen for the object to be placed and a control system. The said printing carriage is installed with print heads and a laser Z height scan sensor. The object with uneven Z height surface elevation features to be printed is placed on the printing platen. The said printing carriage with the laser Z height scan sensor will scan across the object on the X and Y axis to detect the exact target positions of the uneven Z height surface elevation contours on the object. The image processing program can then calculate a precise position to print a given image, or compute an image from the contour shapes to be printed on the object. The method can be featured with high degree of automation, easy control and accurate positioning, so as to improve the inkjet printing quality.

19 Claims, 11 Drawing Sheets

METHOD FOR PRINTING ON ELEVATION CONTOURS OF THE PRINT OBJECT

FIELD OF THE INVENTION

The present invention relates to the method for printing on elevation contours of the print object, more particularly to the recognizing of the uneven Z height surface elevation features on the print object and printing images according to the position of the elevation contours.

BACKGROUND OF THE INVENTION

With its development, the inkjet printing technology has been widely used in various industries. Also a variety of substrates of different materials are being printed on, such as display boards, glasses, tiles, shells of the cell phone, leather products, etc. Usually, the substrates have indent (depression) or emboss (extrasion) of different Z axis height that is defined as uneven Z height surface elevation features, the position of which need to be printed by inkjet printing. In this case, the control system will control the print heads to start printing from the one side of the elevation contours to the other side, so as to make the image or character printed overlap with the contour of the uneven Z height surface elevation features. The existing inkjet printing first performs printing test on the objects and then adjust the position parameters according to the test result, until the position meets the requirement. Using this method, if the print objects are changed, the printing test, position parameter adjustment must be redone, because the position of the uneven Z height surface elevation features are changed. Due to the irregularity of the distribution of the elevation contours or frequent change of the print objects, testing and adjustment will be quite cumbersome.

Sometimes, not only the contours of uneven Z height surface elevation features need to be printed, but also the full coverage pixel points composing the uneven Z height surface elevation features should be printed with image or characters. Under this situation, the image processing program and the recognizing procedure will be more complex.

If the uneven Z height surface elevation features on the object to be printed have color difference, the image processing method can be used to position the different colors, find the position at which the print heads should print and timely print the image or character at this position. If there is no color difference on the uneven Z height surface elevation contours, only using the light and shade changed which reflected by the indent (depression) or emboss (extrasion) to distinguish the elevation contours will cause printing position inaccuracy.

SUMMARY OF THE INVENTION

In view of the problems in the prior art, the purpose of the present invention is to provide with a method of printing on elevation contours of the print object, which uses a non contact Z height laser scan sensor to measure/detect an object surface containing extruded shapes with different Z axis elevation heights to determine the position where to precisely inkjet print outline contours, legends, logo images, or solid fill with materials, which is featured with high degree of automation, easy control and accurate positioning, so as to improve the inkjet printing quality.

To realize the purpose, the present invention present a method of printing on elevation contours of the print object, wherein includes:

a). An inkjet printing apparatus, including a printing carriage, a supporting beam, a printing platen for the object to be placed and a control system, wherein the said printing carriage is installed with print heads and a laser Z height scan sensor, and one or more objects with one or multiple uneven Z height surface elevation features are placed on the said printing platen;

b). Pre-process given images to be printed on the uneven Z height surface elevation features of the print object;

c). A laser Z height scan sensor to detect the uneven Z height surface elevation features of the print object by one or more scan pass on the X and Y axis;

d). An image processing program to recognize the position coordinate of reference point which is the center of each elevation contour relative to the printing platen;

e). Matching position coordinate of the center of each elevation contour on the print object with the center of each pre-process given image and then putting together one or multiple pre-process given images that have the exact position coordinates to form a combined image to be printed;

f). A control system controls the print heads to print the combined image composed by one or multiple pre-process given images on the object.

The method of printing on elevation contours of the print object, wherein the said the pre-process given image in step e) is the two-dimension outline of each uneven Z height surface elevation feature on the print object, and the control system in step controls the print heads to print the combined image of all outlines on the object through scan printing horizontally forward (left) and backward (right) along the X axis.

The method of printing on elevation contours of the print object, wherein the printing carriage included in the printing apparatus in step a) can move forward and backward which is perpendicular with the supporting beam, according with the object motion direction on the Y axis; the pre-process given image in step e) is all the pixel points composing the uneven Z height surface elevation features on the object; the control system in step f) controls the print heads to fill print image/logo/legend or solid fill print with materials into the contour shapes on the object through multi-pass printing forward and backward along the X axis and Y axis.

The method of printing on elevation contours of the print object, wherein the surface of the object with Z height elevation contours to be printed may be regardless of color.

The method of printing on elevation contours of the print object, wherein the laser Z height scan sensor is a two dimensional in-line profilometer sensor which detects the cross section shape through the laser.

The method of printing on elevation contours of the print object, wherein the scanning the laser Z height scan sensor width is larger than the maximum width of the Z height elevation contours on the print object.

The method of printing on elevation contours of the print object, wherein one or multiple the objects to be printed and placed on the platen have the same Z height elevation contours.

The method of printing on elevation contours of the print object, wherein the print heads use UV curving ink.

The method of printing on elevation contours of the print object, wherein a linear encoder scale is installed on the supporting beam.

The method of printing on elevation contours of the print object, wherein the printing platen includes the Z axis height adjustment device by which the distance between the print heads and the printing platen can be adjusted.

The method of printing on elevation contours of the print object, wherein the printing carriage's one side or both sides can be installed with the UV curing device.

The method of printing on elevation contours of the print object, wherein the supporting beam is installed with final UV curing device.

The present invention provides with another method of printing on elevation contours of the print object, wherein it includes:

a). An inkjet printing apparatus, including a printing carriage, a supporting beam, a printing platen for the object to be placed and a control system, wherein the said printing carriage is installed with print heads and a laser Z height scan sensor, and one or more objects with one or multiple uneven Z height surface elevation features are placed on the said printing platen;

b). A laser Z height scan sensor to detect the uneven Z height surface elevation features of the object to be printed by scan pass on the X and Y axis, and an image processing program to recognize the position of the elevation contours on each object relative to the printing platen;

c). Forming a combined image of one or multiple contours to be printed according to the position coordinates of the uneven Z height surface elevation features on each print object;

d). A control system controls the print heads to print the combined image on the object.

The method of printing on elevation contours of the print object, wherein the surface of the object with Z height elevation contours to be printed may be regardless of color.

The method of printing on elevation contours of the print object, wherein the laser Z height scan sensor width is larger than the maximum width of the Z height elevation contours on the print object.

The method of printing on elevation contours of the print object, wherein the Z height elevation contours on the print object can be the same or different.

The method of printing on elevation contours of the print object, wherein the height of the Z height elevation contours on the print object is the same.

The method of printing on elevation contours of the print object, wherein the combined image of one or multiple contours to be printed in step c) is the two-dimension outlines of uneven Z height surface elevation features on the print object, and the control system in step d) controls the print heads to print the image of all outlines on the object through scan printing horizontally forward (left) and backward (right) along the X axis.

The method of printing on elevation contours of the print object, wherein the printing carriage included in the printing apparatus in step a) can move forward and backward along the Y axis which is perpendicular with the supporting beam, according with the object motion direction; the combined image of one or multiple contours to be printed in step c) is all the pixel points composing the uneven Z height surface elevation features on the object; and the control system in step d) controls the print heads to fill print image/logo/legend or solid fill print with materials into the contour shapes on the object through multi-pass printing forward and backward along the X axis and Y axis.

Compared to the invention in the prior art, the achievements of the present invention are:

1. For the print object with uneven Z height surface elevation features, regardless of whether the color of the feather is the same or different, the printing position coordinates can be quickly and accurately be recognized. As to uneven Z height surface elevation features of different shapes, of contour or of profile, their printing can be realized by detection and calculation. These two advantages can expand the application field of inkjet printing.
2. The laser Z height scan sensor can ensure the accurate ink jetting position, because of its high sensitivity and accuracy, strong resistance to electromagnetic interference, non-interference of electric arc light and heat, wide detecting area and non-contact with objects.
3. The laser Z height scan sensor, which is an ultra-high speed in-line profilometer sensor, can detect the cross section shape at the sampling rate of 64,000 contour or 12,800,000 points per second, constantly output the profile data, instantly recongnize all kinds of shapes and form a 3D model as needed, so as to improve work efficiency.
4. If the print object is changed, it is not necessary to redo testing and adjustment; directly scan the object and then print.

DETAILED DESCRIPTION OF THE EMBODIMENT

Figure 1:
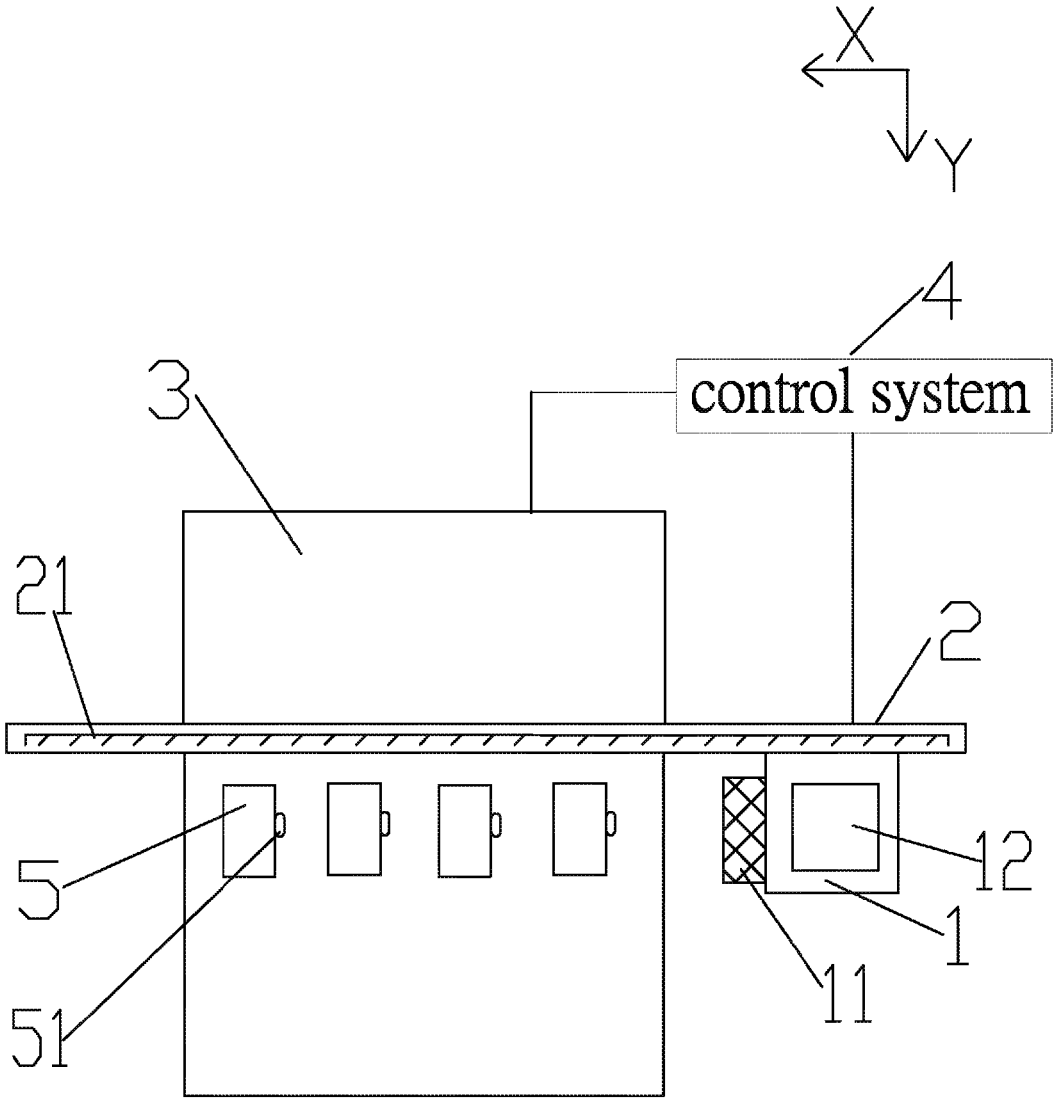
FIG. 1 is a prospective view of the apparatus used for printing on elevation contours of the print object in embodiment 1.

Preferred embodiments of method for printing on elevation contours of the print object according to the present invention is described but not confined below with reference to the accompanying figures. As shown in FIG. 1, the inkjet printing apparatus used for printing on elevation contours of the print object includes a printing carriage 1, a supporting beam 2, a printing platen 3 for the object to be placed and a control system 4; wherein the said printing carriage 1 can move horizontally forward (left) and backward (right) along the supporting beam 2 according with the X axis. The said supporting beam 2 can move forward and backward along the Y axis which is perpendicular with the supporting beam, according with the object motion direction. A laser Z height scan sensor 11, installed on the one side of the printing carriage 1, is to recognize the uneven Z height surface elevation features 51 on the print object 5 and sends the data acquired to the sensor controller (not shown in FIG. 1). And then the software program calculates the position coordinates of the centers of the uneven Z height surface elevation features 51 on the print object 5 placed on the printing platen 3. The printing carriage 1 is also installed with print heads 12 which are to jet inks. To improve the printing effect, the print heads can jet ink of one color or more than one color, such as Cyan (C), Magenta (M), Yellow (Y), Black (K), White (W) and Varnish (V), and all of them are UV curving inks. The number of the print heads 12 installed on printing carriage 1 is decided by the actual printing situation. On the supporting beam 2, a linear encoder scale 21, which can be replaced with a magnetic scale, is installed to recognize the position coordinate of the uneven Z height surface elevation features in X axis. One or more print objects 5 should be placed on the printing platen 3 and they have the same uneven Z height surface elevation features 51. An Z axis height adjustment device (lifting device) (not shown in FIG. 1) is adopted by the printing platen, so as to adjust the distance between the printing platen 3 and the print heads 12. Tooling template which is to locate and arrange the print objects 5 can be placed on the printing platen 3. The control system 4 is to control the inkjet printer to print image or character on the print object 5.

In the present invention, to cure the inks jet on the print object 5 by the print heads 12, UV curing device is fixed to one side or both sides of the print heads 12 installed on the printing carriage 1. Also a UV curing device can be placed right next to each print heads 12. Besides, the final UV curing device can be installed to the supporting beam 2.

Figure 2:
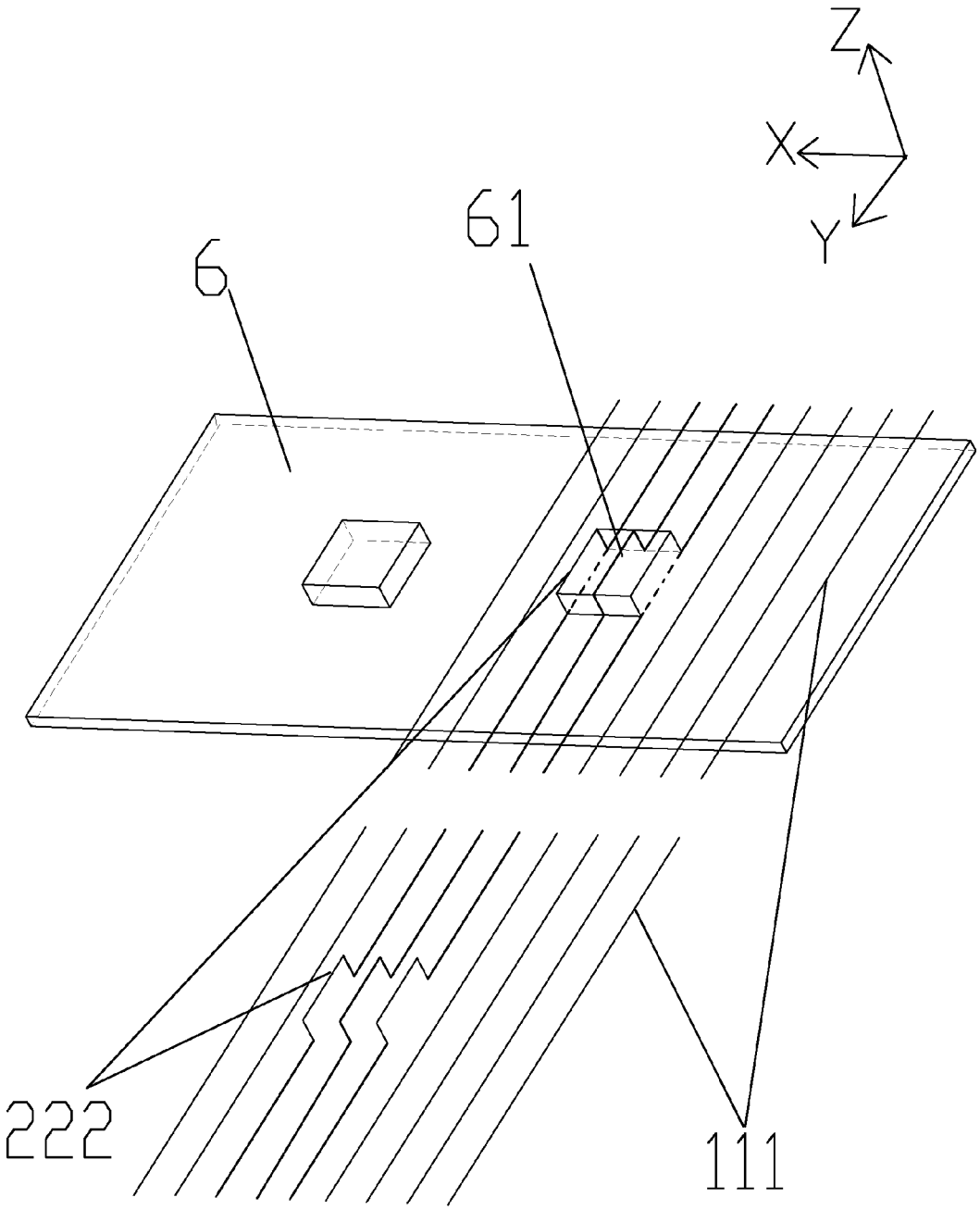
FIG. 2 is a principle sketch map of the elevation contours positioning with the laser Z height scan sensor used by the inkjet printer.

FIG. 2 is a sketch map of positioning the elevation contours with the laser Z height scan sensor 11 in the embodiment of the present invention. The laser Z height scan sensor 11, which is a two dimensional non contact ultra-high speed in-line profilometer sensor, can recognize the Z height elevation contour or cross section shape through the laser. The detailed procedure is described referring to the rectangular parallelepiped print object 6 with cubic uneven Z height surface elevation features 61. First, make sure that the laser Z height scan sensor 11 width is larger than the maximum width of the cubic uneven Z height surface elevation features 61 on the rectangular parallelepiped print object 6. After starting the laser sensor's program, the laser Z height scan sensor 11, moving along the X axis with the printing carriage 1, will emit laser to the top surface of the rectangular parallelepiped print object 6 to scan the object in X axis. While the laser Z height scan sensor 11 is going through the flat surface of rectangular parallelepiped print object 6, straight lines 111 will be fed back by the laser measurement program. However, if the laser Z height scan sensor 11 scans the cubic uneven Z height surface elevation features 61 on the rectangular parallelepiped print object 6, the cross-section shape 222 of the cubic uneven Z height surface elevation features 61 will be fed back by the laser measurement program. Thus the laser Z height scan sensor 11 detects the uneven Z height surface elevation features 61 by scan pass. During the scanning process, the linear encoder scale gives the X axis coordinate; the laser Z height scan sensor 11 acquires the Z axis coordinate of the points on the surface of the cubic uneven Z height surface elevation feature 61. Thus the cross section shape of 222 in the plane YZ will be formed and the Y axis coordinate of each point formed the contours of the uneven Z height surface elevation features will acquired according to the cross section shape 222.

Embodiment 1

This embodiment is a description of the inkjet printing method for one or multiple print objects with the same elevation contours.

Figure 3:
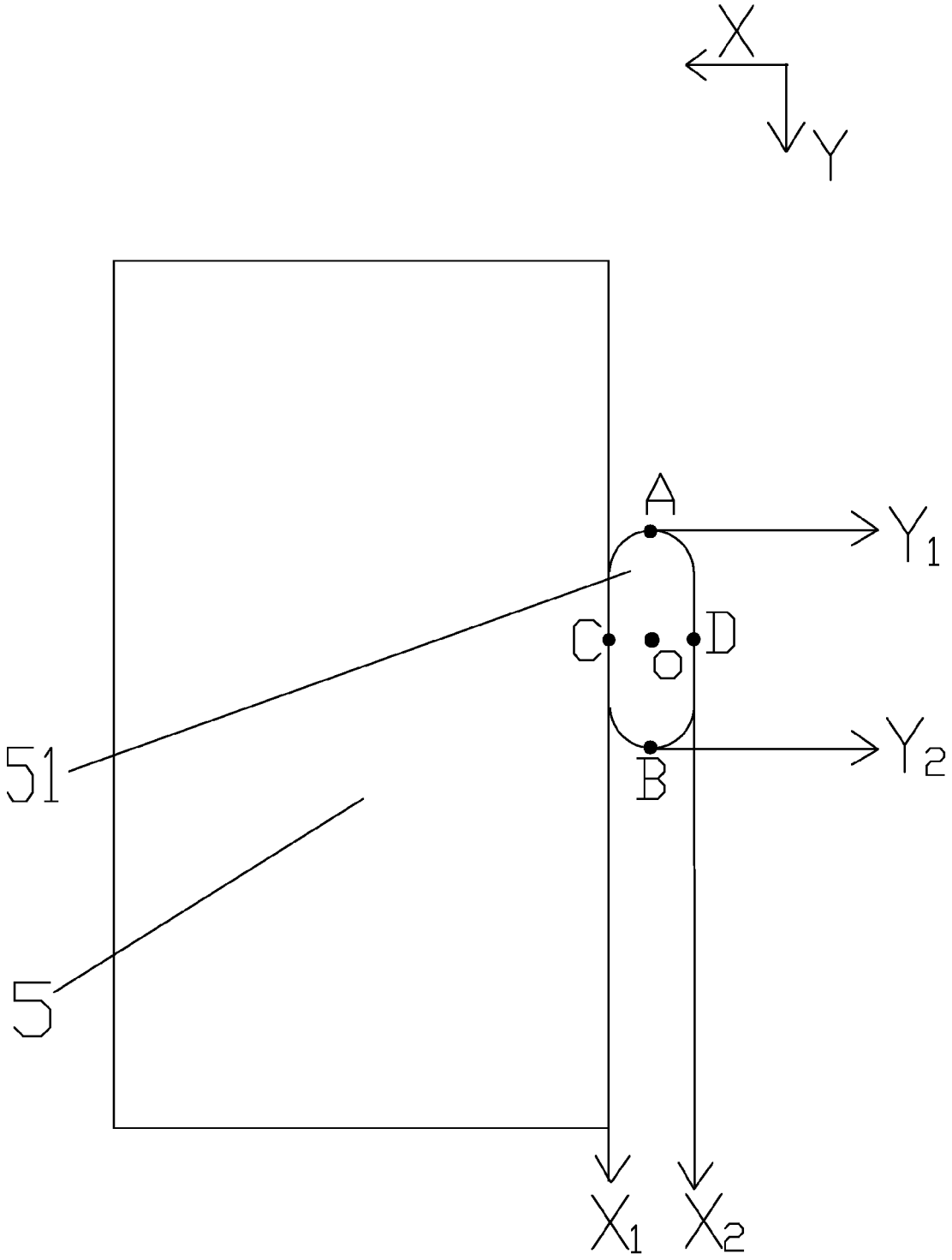
FIG. 3 is a principle sketch map of recognizing the position coordinate of the elevation contours center in Embodiment 1.

After the laser Z height scan sensor 11 detects the uneven Z height surface elevation feature 51 on the print object 5, the software program will find out the extreme points A, B, C and D according to the cross section shape in the YZ plane and then form a profile according to the uneven Z height surface elevation feature 51. As shown in FIG. 3, C and D are the extreme points in the X axis, while A and B are extreme points in the Y axis. After scanning, the laser Z height scan sensor 11 acquires the Y axis coordinate of $Y_1$ for point A, and $Y_2$ for point B. And then the software program will calculate the Y axis coordinate $Y_0$ of the central point O and $Y_0=(Y_1+Y_2)/2$. The X axis coordinates of point C and D is given by the linear encoder scale. The point C's X axis coordinate is $X_1$, while point D's X axis coordinate is $X_2$. Then the software program calculates the X axis coordinate of central point O is $X_0$, and $X_0=(X_1+X_2)/2$. After the software calculation, the coordinate of the central point of the uneven Z height surface elevation feature 51 will be get, which is $(X_0, Y_0)$.

Figure 4:
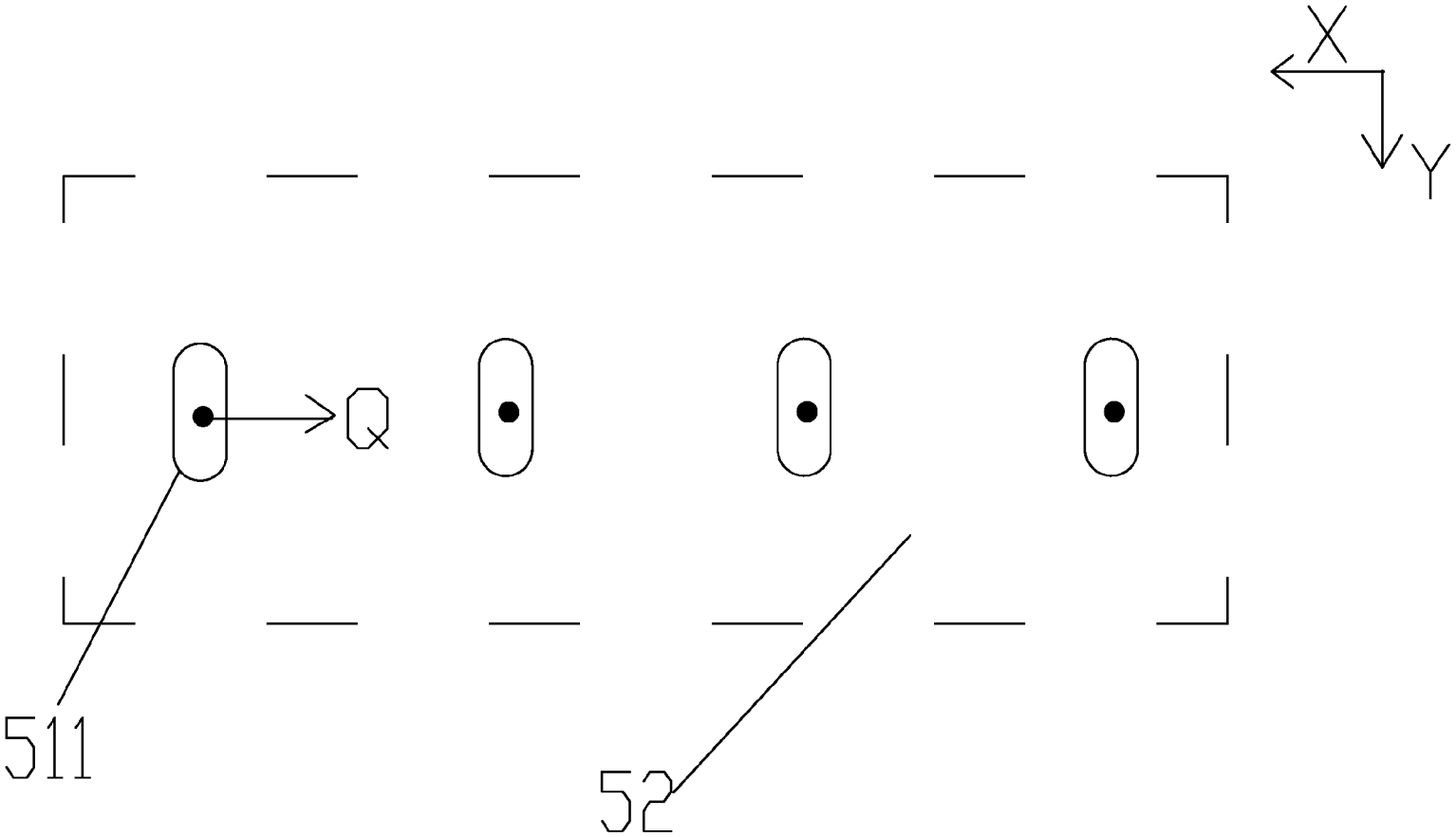
FIG. 4 is a sketch map of the combined image to be printed and composed of pre-process given images in Embodiment 1.

As shown in FIG. 4, the image processing program provides a pre-process given image 511 consistent with the uneven Z height surface elevation feature 51 on the print object 5. The image processing program matches the central point O $(X_0, Y_0)$ of the uneven Z height surface elevation feature 51 on each print object 5 with the central point P of the pre-process given image 511. Because one or more print objects 5 are placed on the printing platen 3, the program will put together the pre-process given image 511 whose position have been located to form a combined image 52 of one or multiple contours. This combined imaged will be accurately printed on the surface of uneven Z height surface elevation features on print object 5.

Figure 5:
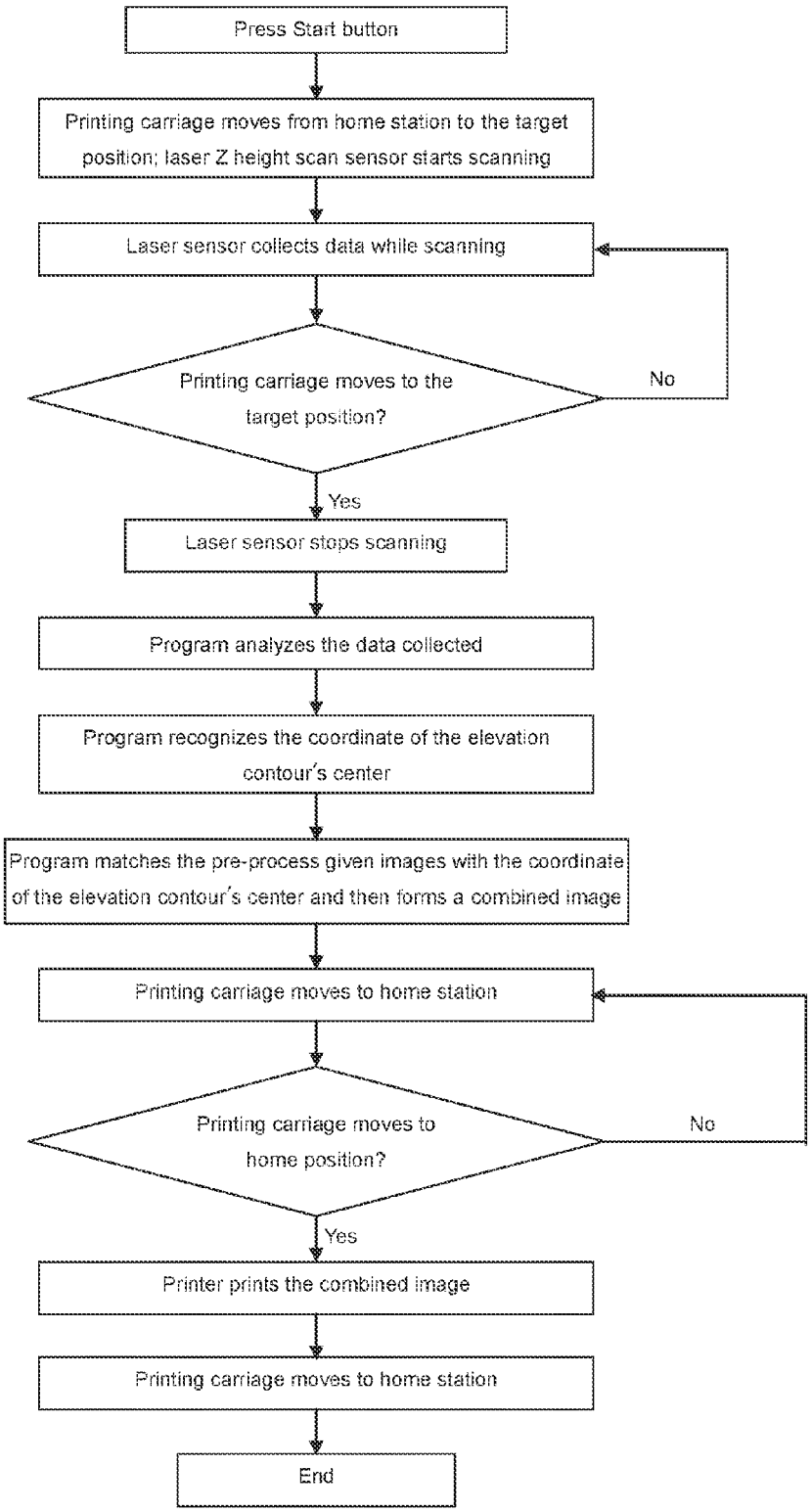
FIG. 5 is a flowchart of the printing on elevation contours of the print object in Embodiment 1.

The flowchart of the embodiment is shown in FIG. 5. After connecting electricity to the printer and pressing start button, the printing carriage 1 will move from home station to the target position along the supporting beam 2, according with X axis. At the same time, the laser Z height scan sensor 11, with its laser emitting program started up and scanning with the carriage along the supporting beam, scans the print object 5 under it and collects the data of the uneven Z height scan features 51 on the print object 5. Then the program checks if the printing carriage moves to the target position that is the end position of the one-pass scanning path. If not, the laser Z height scan sensor 11 continues scanning and collecting data. Otherwise, the laser Z height scan sensor 11 stops scanning, the program analyzes the data collected and then recognizes the position coordinates, which are coordinates on the printing platen 3, of the central point O of the (elevation contour) uneven Z height surface elevation feature 51 on the print object 5. The central point O whose position coordinate has been located, will match with the central point Q of the pre-process given image 511 which is provided by the image processing program and be consistent with the uneven Z height surface elevation features on the print object, so that the position of the point Q will be get. Then the program puts together (matches) the pre-process given image with the position coordinate of the elevation contour's center being located to form a combined image 52 of one or multiple contours. After that, the printing carriage 1 moves to its home station again. The program checks if the printing carriage moves back to home station? If the printing carriage 1 doesn't arrive to its home station, the control system 4 controls it to continue moving. If it reaches the home station, the control system 4 controls print heads 12 to print the combined imaged on the print object 5, until the whole image is printed. At last, printing carriage moves to home station, the printing is end.

If the image to be printed is the two-dimension outline of the uneven Z height surface elevation feature 51, the control system 4 controls the print heads 12 to print the image of all outlines on print object 5 through one scan pass printing horizontally forward (left) and backward (right) along the X axis.

If the image to be printed is all the pixel points composing the uneven Z height surface elevation features 51, the control system 4 controls the print heads to fill or solid fill print the image/logo/legend/single-ink material into the elevation contour shapes on the object through multi-pass printing horizontally forward (left) and backward(right) along the X axis, with the supporting beam 2 moving forward and backward in Y axis which is perpendicular with the supporting beam, according with the object motion direction. Filling print the image/logo/legend can be in order to make the elevation contour more beauty, and solid filling print the single-ink material can be in order to make the elevation contour with indent (depression) for smooth feel look and flat with other areas that aren't printed on the object surface.

Embodiment 2

This embodiment is a detailed description of the inkjet printing method for one or more print objects with elevation contours of the same height or depth but different contour.

Figure 6:
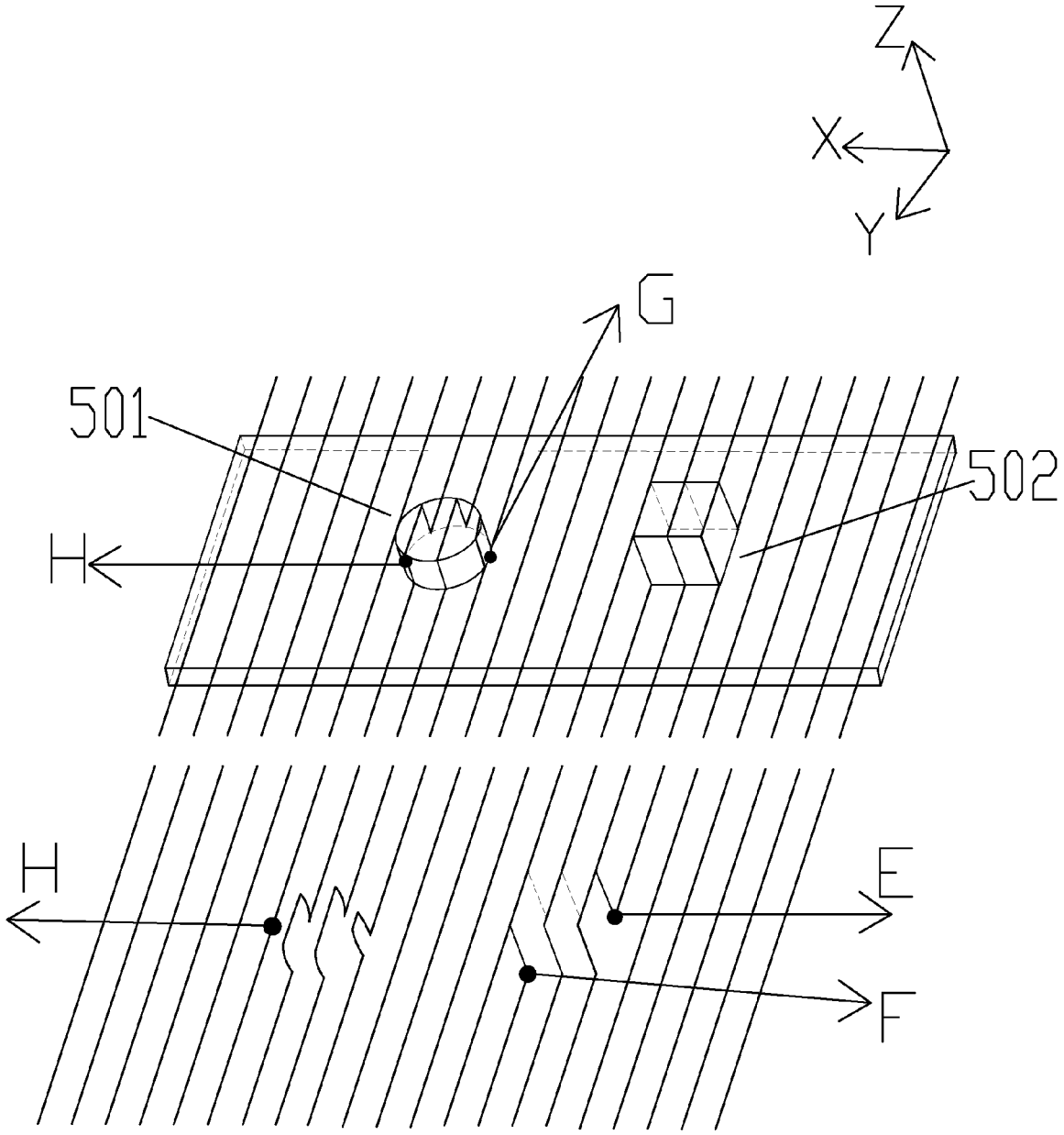
FIG. 6 is a principle sketch map of recognizing the position coordinates of the elevation contours in Embodiment 2.
Figure 7:
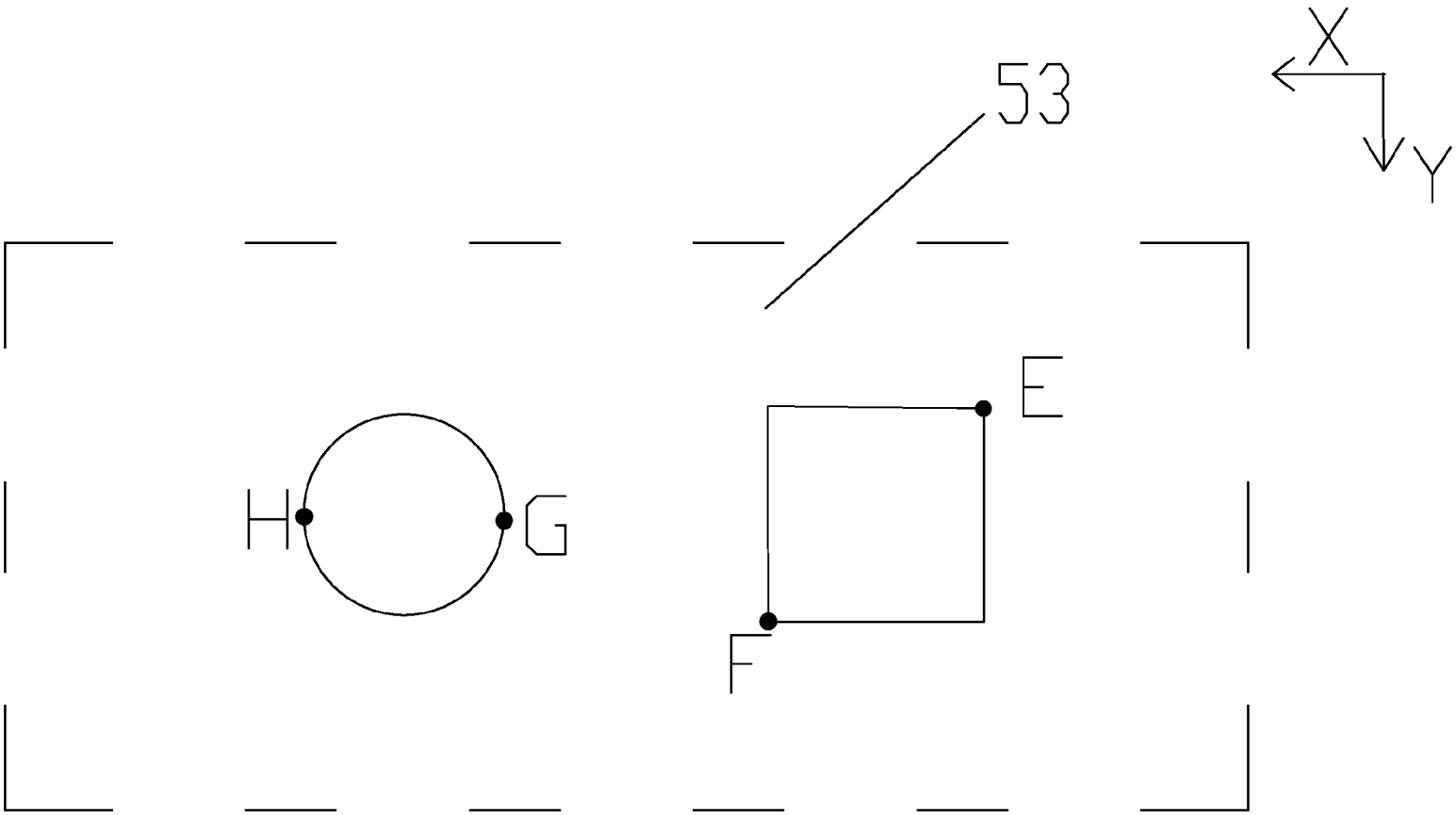
FIG. 7 is a sketch map of the combined image to be printed in Embodiment 2.

As shown in FIG. 6, uneven Z height surface elevation features 501 and 502 are different in profile. The laser Z height scan sensor 11 detects the uneven Z height surface elevation features by one scan pass to acquire the cross section shape in the YZ plane. While the laser Z height scan sensor 11 is scanning the uneven Z height surface elevation feature 501, the image processing program finds out all the contour(profile) points of the uneven Z height surface elevation features 501, started from point E and ended with point F. Then the image processing program forms the cross section shape of the uneven elevation contour in XY plane. The linear encoder scale gives the X axis coordinate and the laser Z height scan sensor 11 gives the Y axis coordinate according to the cross section shape. After that, the coordinates, which are coordinates on the printing platen3, of all the uneven Z height surface elevation feature 501's profile points from E and ended with F will be calculated. After scanning the uneven Z height surface elevation features of 501, the laser Z height scan sensor 11 goes through the flat surface of the print object and straight lines will be fed back by the laser measurement program. While the laser Z height scan sensor 11 is scanning the uneven Z height surface elevation feature 502, the laser measurement program acquires its cross section shape and image processing program gets all the pixel profile points on the surface of the uneven elevation contour, started from point G and ended with point H. Then the program calculates the coordinate of uneven Z height surface elevation feature 502's profile points from G to H on the printing platen 3. After all of these steps, the image processing program forms a combined image 53, as shown in FIG. 7, according to the coordinates of all the pixel profile points of the uneven elevation contours.

Figure 8:
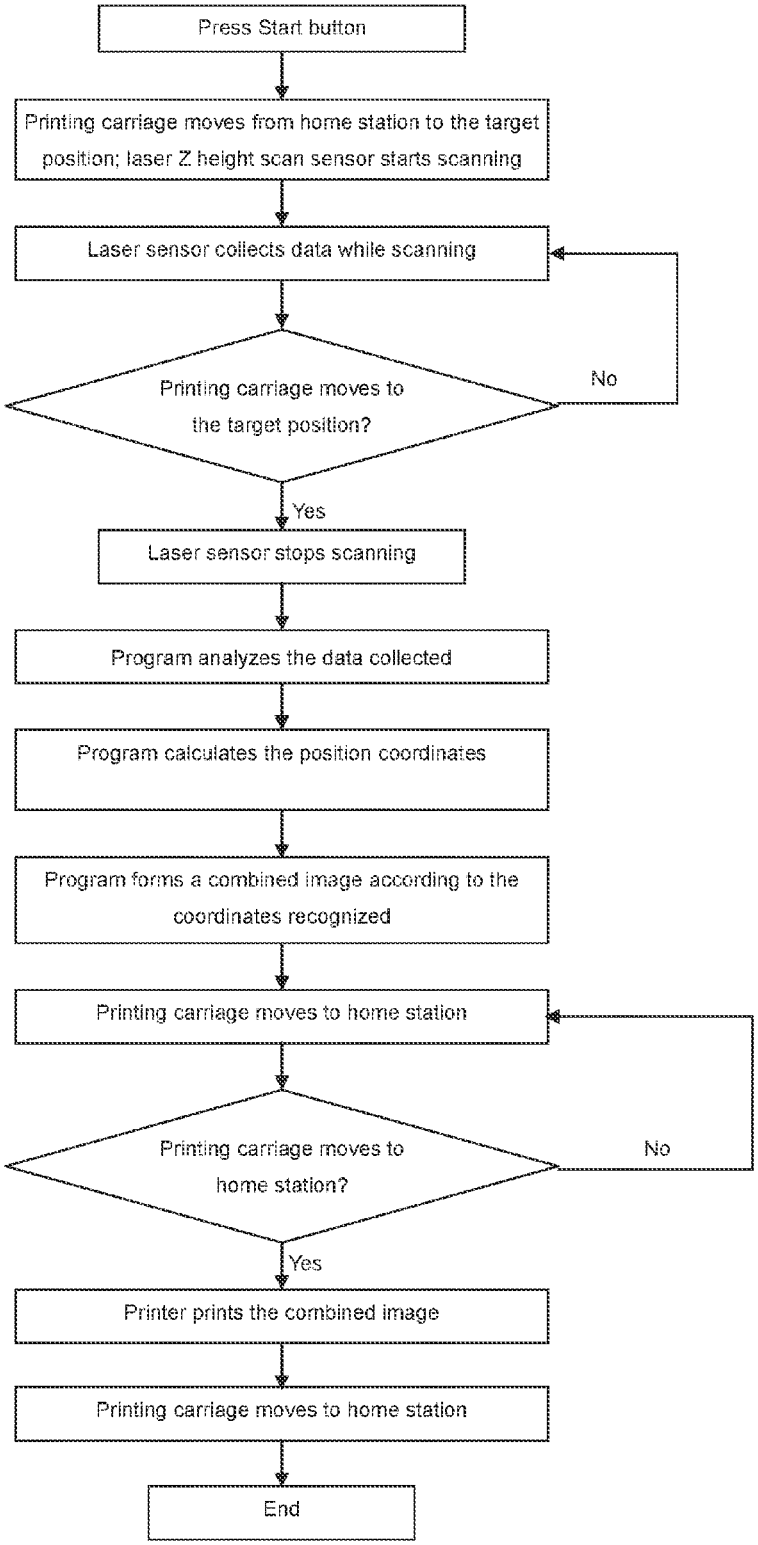
FIG. 8 is a flowchart of the printing on elevation contours of the print object in Embodiment 2.

FIG. 8 is the flowchart of the method for printing on elevation contours of the print object in embodiment 2. After connecting electricity to the printer and pressing the start button, the printing carriage 1 will move from its home station to the target position along the supporting beam 2 according with the X axis. At the same time, the laser Z height scan sensor 11 starts scanning, with its laser emitting program started up and moving with the printing carriage 1 along the supporting beam 2. The laser Z height scan sensor 11 scans the print object under it and collects the data of the uneven Z height surface elevation features 501 and 502 on the print object. Then the program checks if the printing carriage moves to the target position that is the end position of the one-pass scanning path. If not, the laser Z height scan sensor 11 continues scanning and collecting data. Otherwise, the laser Z height scan sensor 11 stops scanning and image processing program analyzes the data collected and then calculates the position coordinates, which are coordinates on the printing platen 3, of the all pixel points composing the cross section shape of the (elevation contours) uneven Z height surface elevation features 501 and 502. Then the program put together all pixel points coordinates to form a combined image 53. After that, the printing carriage 1 moves to its home station again. If the printing carriage 1 doesn't arrive to its home station, the control system 4 controls it to continue moving. If it reaches the home station, the control system 4 controls print heads 12 to print the combined imaged 53 on the print object, until the whole image is printed. At last, printing carriage moves to home station, the printing is end.

If the image to be printed is the two-dimension contour of the uneven Z height surface elevation feature 501 and 502, the control system 4 controls the print heads 12 to print the image on print object through one scan pass printing horizontally forward (left) and backward (right) along the X axis.

If the image to be printed is all the pixel points composing of the uneven Z height surface elevation feature 501 and 502, the control system 4 controls the printing carriage 1 to move in Y axis which is perpendicular with the supporting beam 2, according with the object motion direction, and the printing heads 12 to fill or solid fill print the image/logo/legend/single-ink material into the contour shapes on the print object through multi-pass printing horizontally forward (left) and backward(right) along the X axis.

Embodiment 3

This embodiment is a detailed description of the inkjet printing method for one or more print objects that are characterized with one or multiple elevation contours of regular shape and at least one elevation contours of irregular shape.

Figure 9:
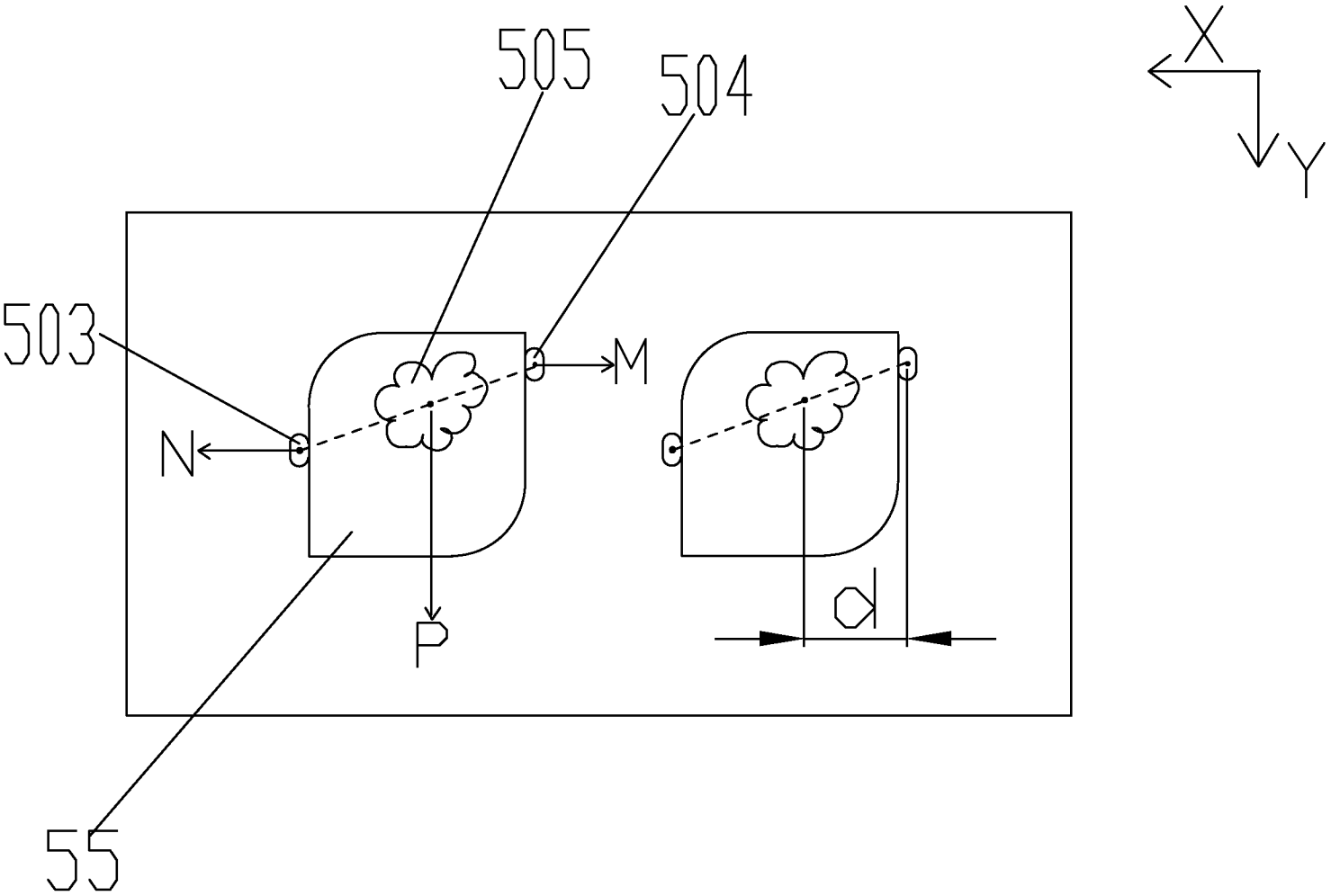
FIG. 9 is a schematic diagram of the method to recognizing the elevation contours in irregular shape in Embodiment 3.

As shown in FIG. 9, the print object 55 has several elevation contour features, 503, 504 and 505, among which elevation contour feature 503 and 504 are of regular shape and 505 is of irregular shape. The laser Z height scan sensor 11 and the software program can detect and calculate the coordinate of central point M of elevation contour feature 503 and that of the central point N of elevation contour feature 504. The software program also can calculate and locate the coordinate $(X_5, Y_5)$, which is the coordinate on the printing platen 3, of the elevation contour feature 505's central point P according to the coordinate of point M and N. The method to get the coordinate of the point P is to find out the geometric relation between the point P, M and N, which means that point P is on the connecting line of point M and N, and horizontal distance between the point P and M is "d". After that, the software program matches the coordinate of central point P with the center of each pre-process given image, and put together the images whose position have been located to form a combined image. Then the control system controls the print head to print the combined image on the print object.

Embodiment 4

Figure 10:
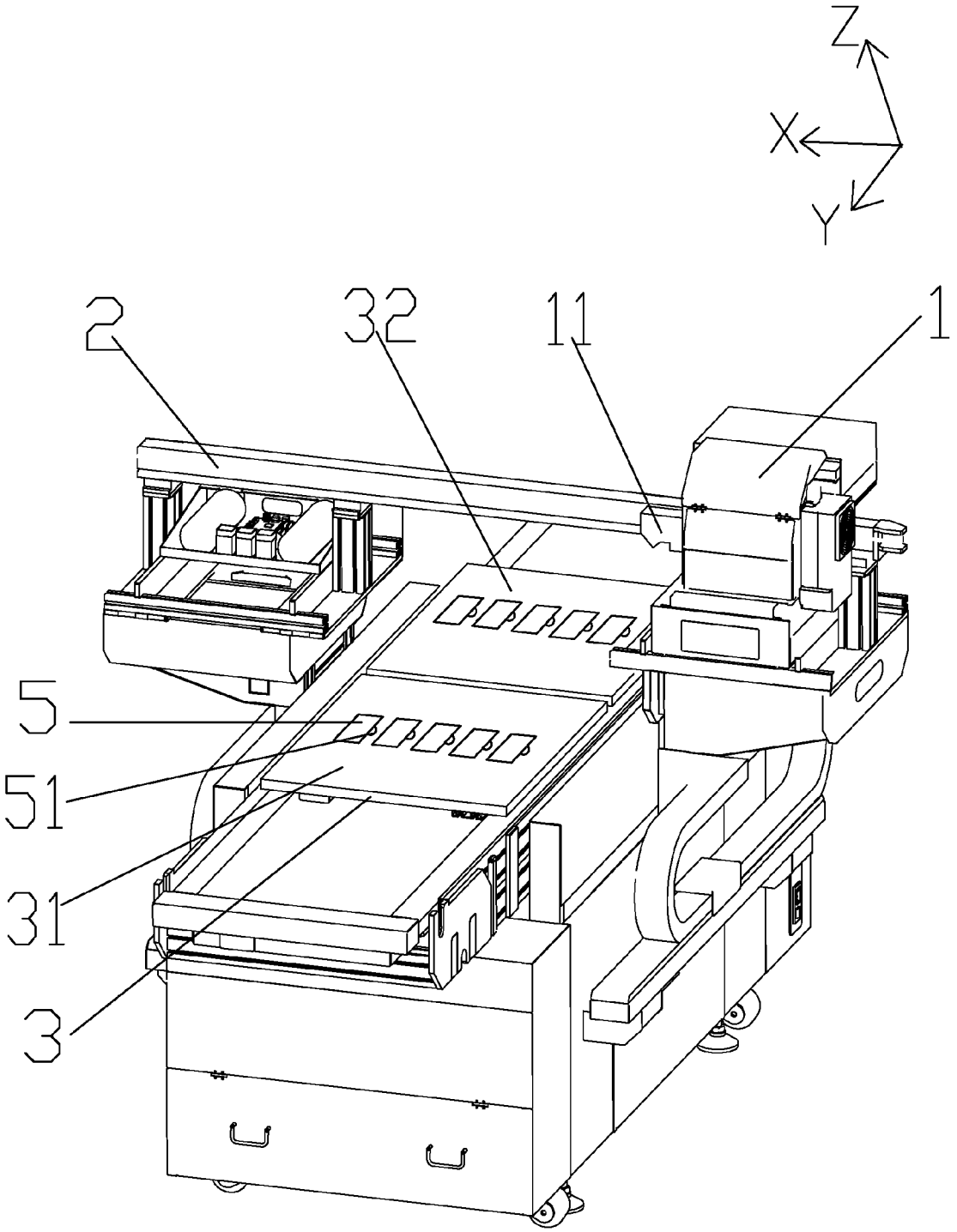
FIG. 10 is a model prospective view of the apparatus used for printing on elevation contours of the print object in Embodiment 4.

As shown in FIG. 10, the apparatus for printing on elevation contours of the print object in this embodiment includes a printing carriage 1, a supporting beam 2, a printing platen 3 for the print object to be placed and a control system (not shown in FIG. 10). There are two printing platens in this embodiment: platen 31 and platen 32, under which a movement control module (not shown in FIG. 10) is installed. This module is to control the two platens 31 and 32 to move forward and backward in the direction that is perpendicular with the supporting beam 2 along the Y axis. On each printing platen, there is a tooling template (not shown in FIG. 10) which is to place and arrange the print object 5 with uneven Z height surface elevation features 51. The printing carriage 1 can move along the supporting beam 2 in the X axis. The laser Z height scan sensor 11 installed to one side of the printing carriage 1 is to detect the uneven Z height surface elevation features 51 on the print object 5. The control system is to control the inkjet printer to print the image on the print object 5.

Here is the detailed printing procedure. Press the print button, the first printing platen 31 stays under the supporting beam 2. The printing carriage 1 moves from its home station along the supporting beam 2 to its end position on the opposite side. While the printing carriage 1 is moving, the laser Z height scan sensor 11 on one side of the carriage also moves with the carriage. While moving, the laser Z height scan sensor 11 scans the print object 5 under it, detects the uneven Z height surface elevation feature 51 on the print object 5 and then calculates the coordinate, which is a coordinate on the printing platen 3, of the elevation contour's center. After the one scan pass of the laser Z height scan sensor 11, the software program matches the coordinate of the elevation contour's center point with the center of the pre-process given image provided by the image processing program and be consistent with the uneven Z height surface elevation features, and then puts together the images with its position located to form a combined image. After that, the control system orders the printing carriage 1 moves back to its home station and then to move along the supporting beam 2, so as to print the combined image on the print object 5. After finishing printing, printing carriage 1 goes back to its home station again.

After printing the image on the print object 5 placed on the printing platen 31, the movement control module under the printing platen 3 controls the platen 31 to move backward in the direction that is perpendicular with the supporting beam 2 and away from the position under the supporting beam 2, so that the printing platen 32 will take the position under the supporting beam 2. Then the printing carriage again moves along the supporting beam 2 and prints the image on print object 5 placed on printing platen 32 by repeating printing steps of platen 31. While the printer is printing on platen 32, the operator can unload the printed object on printing platen 31 and reload the new object to be printed. After printing the image on the print object 5 placed on the printing platen 32, the movement control module controls printing platen 32 to move forward in the direction that is perpendicular with the supporting beam 2 and away from the position under the supporting beam 2, so that printing platen 31 will take the position under the supporting beam 2. While the printer is printing on platen 31, the operator can unload the printed object on platen 32 and reload new object to be printed. Alternately print on the two platens, until all images are printed on objects.

Embodiment 5

Figure 11:
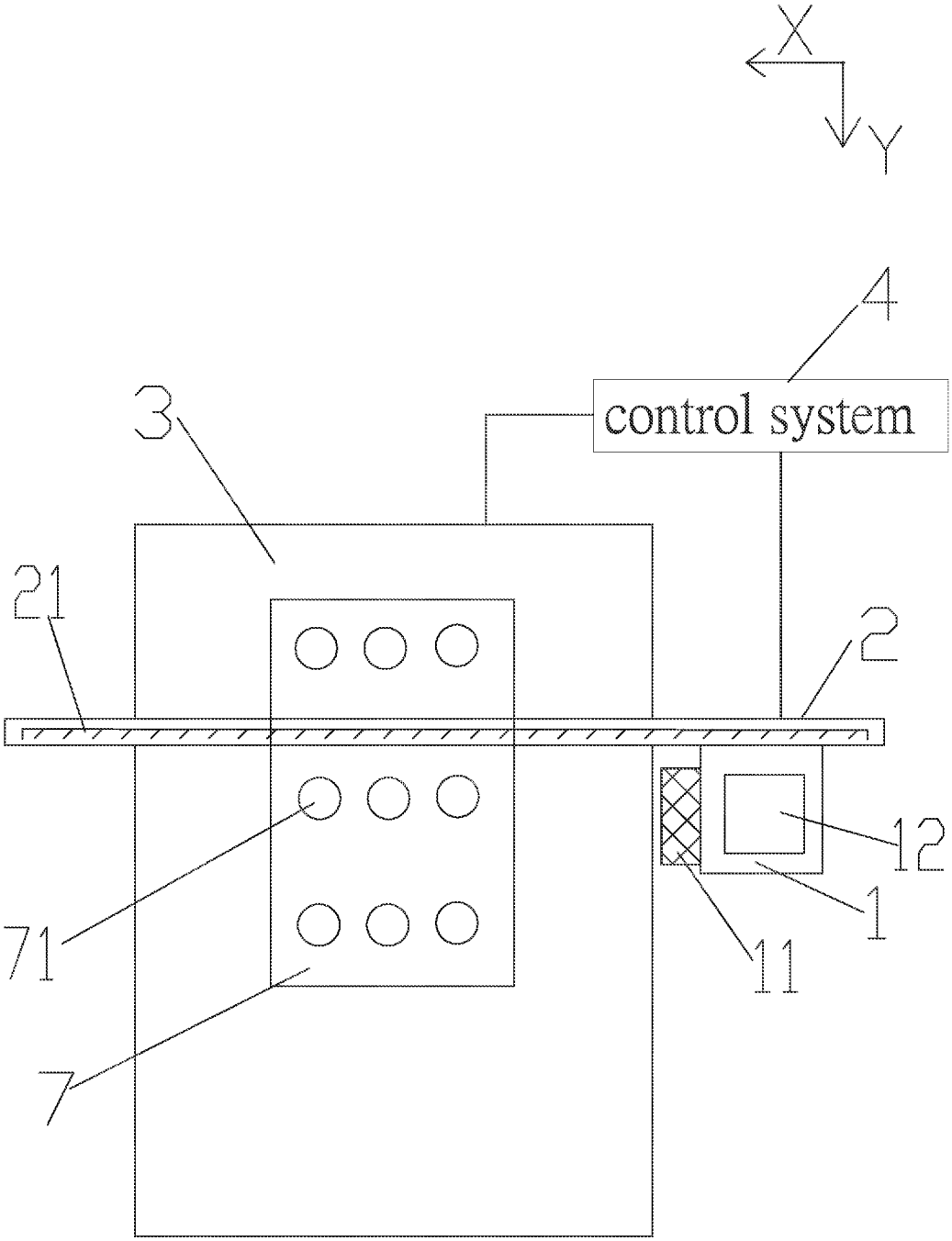
FIG. 11 is a prospective view of the apparatus used for printing on elevation contours of the print object in Embodiment 5.

FIG. 11 is a sketch map of the method for printing on elevation contours of the print object in another embodiment. The positioning and printing apparatus for the uneven Z height surface elevation surface in this embodiment includes a printing carriage 1, a supporting beam 2, a printing platen 3 for the print object and the control system 4. The printing carriage 1 can move horizontally forward (left) and backward (right) along the supporting beam 2 according with the X axis, and the supporting beam 2 can move forward and backward along the Y axis which is perpendicular with the supporting beam 2 according with the object motion direction. Printing object 7 with multi-row uneven Z height surface elevation features 71 is placed on the printing platen 3 and the uneven Z height surface elevation features can be the same or different. The maximum width of the features in each row is smaller than the scanning width of the laser Z height scan sensor 11, while the height or depth of the uneven Z height surface elevation features 71 is the same. The laser Z height scan sensor 11 detects the uneven Z height surface elevation features 71 in the first row by one scan pass, and then the software program calculates the position coordinates of the uneven Z height surface elevation features 71 to form a combined imaged. Then the control system 4 controls the print heads 12 to print the image on the surface of the elevation contours in the first row by one-pass or multi-pass printing horizontally forward (left) and backward (right) along the X axis or Y axis. After printing the first row, the printing carriage 1 goes back to its home station and the supporting beam 2 moves to the next row of the elevation contours along the Y axis. After that, the laser Z height scan sensor 11 detects the elevation contours in the second row by one scan pass, and then the software program calculates the coordinate of the elevation contours to form another combined image. Then the control system 4 controls the print heads 12 to print the image on the surface of the elevation contours in the second row by one-pass or multi-pass printing along the X axis or Y axis. The printer repeats the above procedure until all rows of elevation contours are printed with image.

It is to be understood that any alternations and modifications made to the detailed embodiment herein shall not depart from the scope of the claim and spirit of the present invention.

What claimed is:

1. A method of printing on elevation contours of the print object comprising:

a). An inkjet printing apparatus, including a printing carriage, a supporting beam, a printing platen for the object to be placed and a control system, wherein the said printing carriage is installed with print heads and a laser Z height scan sensor, and one or more objects with one or multiple uneven Z height surface elevation features are placed on the said printing platen;

b). Pre-process given images to be printed on the uneven Z height surface elevation features of the print object;

c). A laser Z height scan sensor to detect the uneven Z height surface elevation features of the print object by one or more scan pass on the X and Y axis;

d). An image processing program to recognize the position of a reference point which is the center of each elevation contour relative to the printing platen;

e). Matching position coordinate of the center of each elevation contour on the print object with the center of each pre-process given image and then putting together one or multiple pre-process given images that have the exact position coordinates to form a combined image to be printed;

f). A control system controls the print heads to print the combined image composed by one or multiple pre-process given images on the object.

2. The method of printing on elevation contours of the print object claim 1, wherein the pre-process given image in step e) is the two-dimension outline of each uneven Z height surface elevation feature on the print object, and the control system in step f) controls the print heads to print the image of all outlines on the object through scan printing horizontally forward (left) and backward (right) along the X axis.

3. The method of printing on elevation contours of the print object claim 1, wherein the printing carriage included in the printing apparatus in step a) can move forward and backward which is perpendicular with the supporting beam, according with the object motion direction on the Y axis; the pre-process given image in step e) is all the pixel points composing the uneven Z height surface elevation features on the object; and the control system in step f) controls the print heads to fill print image/logo/legend or solid fill print with materials into the contour shapes on the object through multi-pass printing forward and backward along the X axis and Y axis.

4. The method of printing on elevation contours of the print object claim 1, wherein the surface of the object with Z height elevation contours to be printed may be regardless of color.

5. The method of printing on elevation contours of the print object claim 1, wherein the laser Z height scan sensor is a two dimensional in-line profilometer sensor which detects the cross section shape through the laser.

6. The method of printing on elevation contours of the print object claim 1, wherein the laser Z height scan sensor width is larger than the maximum width of the Z height elevation contours on the print object.

7. The method of printing on elevation contours of the print object claim 1, wherein one or multiple the objects to be printed and placed on the platen have the same Z height elevation contours.

8. The method of printing on elevation contours of the print object claim 1, wherein the print heads use UV curving ink.

9. The method of printing on elevation contours of the print object claim 1, wherein a linear encoder scale is installed on the supporting beam.

10. The method of printing on elevation contours of the print object claim 1, wherein the printing platen includes the Z axis height adjustment device by which the distance between the print heads and the printing platen can be adjusted.

11. The method of printing on elevation contours of the print object claim 1, wherein the printing carriage's one side or both sides can be installed with the UV curing device.

12. The method of printing on elevation contours of the print object claim 1, wherein the supporting beam is installed with final UV curing device.

13. A method of printing on elevation contours of the print object comprising:

a). An inkjet printing apparatus, including a printing carriage, a supporting beam, a printing platen for the object to be placed and a control system, wherein the said printing carriage is installed with print heads and a laser Z height scan sensor, and one or more objects with one or multiple uneven Z height surface elevation features are placed on the said printing platen;

b). A laser Z height scan sensor to detect the uneven Z height surface elevation features of the print object by scan pass on the X and Y axis, and an image processing program to recognize the position of elevation contours on each object relative to the printing platen;

c). Forming a combined image of one or multiple contours to be printed according to the position coordinates of the uneven Z height surface elevation features on each print object;

d). A control system controls the print heads to print the image on the object, and the image may be all outlines or logo/legend image to be flood fill printed.

14. The method of printing on elevation contours of the print object claim 13, wherein the surface of the object with Z height elevation contours to be printed may be regardless of color.

15. The method of printing on elevation contours of the print object claim 13, wherein the laser Z height scan sensor width is larger than the maximum width of the Z height elevation contours on the print object.

16. The method of printing on elevation contours of the print object claim 13, wherein the Z height elevation contours on the print object can be the same or different.

17. The method of printing on elevation contours of the print object claim 13, wherein the height of the Z height elevation contours on the print object is the same.

18. The method of printing on elevation contours of the print object claim 13, wherein the combined image of one or multiple contours to be printed in step c) is the two-dimension outlines of the uneven Z height surface elevation features on the print object, and the control system in step d) controls the print heads to print the image of all outlines on the object through scan printing horizontally forward (left) and backward (right) along the X axis.

19. The method of printing on elevation contours of the print object claim 13, wherein the printing carriage included in the printing apparatus in step a) can move forward and backward along the Y axis which is perpendicular with the supporting beam, according with the object motion direction; the combined image of one or multiple contours to be printed in step c) is all the pixel points composing the uneven Z height surface elevation features on the object; and the control system in step d) controls the print heads to fill print image/logo/legend or solid fill print with materials into the contour shapes on the object through multi-pass printing forward and backward along the X axis and Y axis.

* * * * *